US006923239B2

(12) United States Patent
Cagle et al.

(10) Patent No.: US 6,923,239 B2
(45) **Date of Patent: *Aug. 2, 2005**

(54) CASTING METHOD AND APPARATUS

(75) Inventors: Billy J. Cagle, Huntland, TN (US); Paul E. Flick, Indianapolis, IN (US); Arthur D. Parks, Greenfield, IN (US); Edward A. Reelfs, Davenport, IA (US)

(73) Assignee: International Engine Intellectual Property Company, LLC, Warrenville, FL (US)

( * ) Notice: Subject to any disclaimer, the term of this patent is extended or adjusted under 35 U.S.C. 154(b) by 32 days.

This patent is subject to a terminal disclaimer.

(21) Appl. No.: 10/653,343

(22) Filed: Sep. 2, 2003

(65) Prior Publication Data

US 2004/0118548 A1 Jun. 24, 2004

Related U.S. Application Data

(63) Continuation-in-part of application No. 09/608,176, filed on Jun. 30, 2000, now Pat. No. 6,644,381.

(60) Provisional application No. 60/142,334, filed on Jul. 2, 1999.

(51) Int. Cl.[7] ..... B22C 25/00; B22D 33/00

(52) U.S. Cl. ..... 164/5; 164/130; 164/137; 164/323; 164/339; 164/394

(58) Field of Search ..... 164/5, 137, 339, 164/341, 322–331, 394–396, 409, 130

(56) References Cited

U.S. PATENT DOCUMENTS 5,163,500 A * 11/1992 Seaton et al. ..... 164/130
5,524,703 A * 6/1996 Landua et al. ..... 164/200

FOREIGN PATENT DOCUMENTS

DE 2 304 564 * 8/1974

* cited by examiner

*Primary Examiner*—Kuang Y. Lin
(74) *Attorney, Agent, or Firm*—Dennis Kelly Sullivan; Susan L. Lukasik; Jeffrey P. Calfa

(57) ABSTRACT

The use of green sand is eliminated by replacing green sand molds with all core sand assemblies that provide, during casting, both the internal and external surfaces of a casting, such as a cylinder head or engine block. In the process, a mold is formed from the same core sand that is used to form the core elements defining the internal passageways of the casting. A mold-core carrier is constructed with downwardly converging sides that hold assembled mold and core elements together, without fasteners, during transportation and pouring of the molten iron alloy into the mold-core assembly and the cooling period to form the casting. After the casting is formed, the core sand from both the mold elements and core elements is recovered, and may be recycled and processed to form further mold elements or core elements or both.

19 Claims, 5 Drawing Sheets

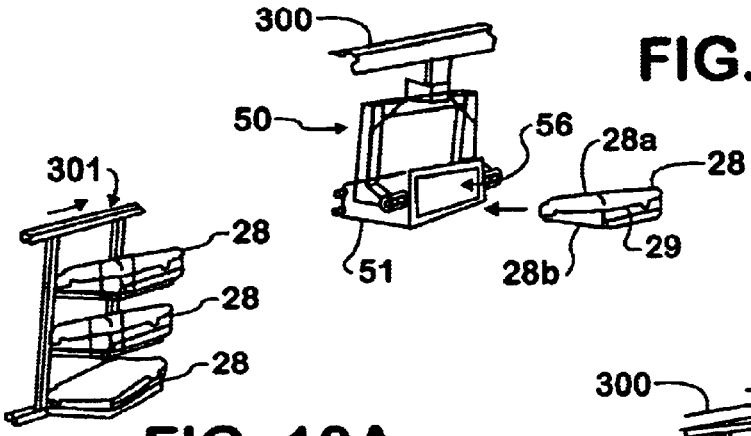
FIG. 10B
FIG. 10A
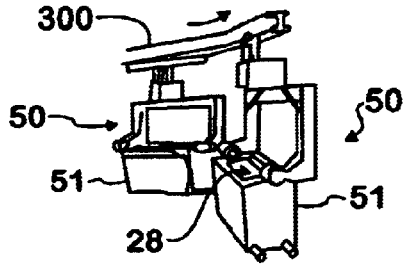
FIG. 10C
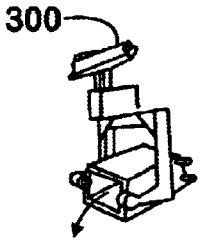
FIG. 10E
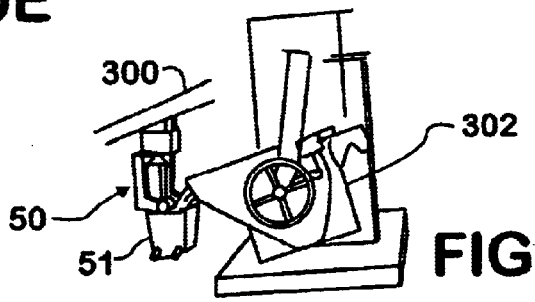
FIG. 10D
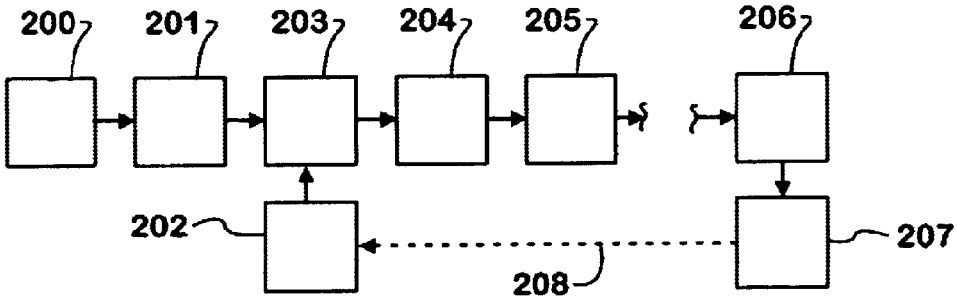
FIG. 9

CASTING METHOD AND APPARATUS

This patent application is a continuation in part of U.S. patent application Ser. No. 09/608,176 filed Jun. 30, 2000, now U.S. Pat. No. 6,644,381, and claims the benefit of Provisional U.S. patent application Ser. No. 60/142,334, filed Jul. 2, 1999.

FIELD OF THE INVENTION

This invention relates to methods and apparatus for use in casting, particularly for use in casting large, iron alloy articles such as cylinder heads and cylinder blocks for internal combustion engines.

BACKGROUND OF THE INVENTION

Traditional casting methods generally employ a "green sand" mold which forms the external surfaces of the cast object and the passageways into which the molten iron alloy is poured for direction into the mold cavity. A green sand mold is a mixture of sand, clay and water that has been pressure formed into the mold element. Green sand molds have sufficient thickness so that they provide sufficient structural integrity to contain the molten metal during casting and thereby form the exterior walls of the casting. The structural integrity of the green sand molds, however, is not completely satisfactory and the green sand can easily yield to the pressure that may be exerted by the hands of a workman.

For example, in casting a cylinder head, a green sand mold is provided with a cavity and preformed cavity portions to position and hold core elements that form the exhaust gas, air intake, and coolant passageways and other internal passageways in the cast cylinder head.

The coolant passages are frequently formed with two core elements to permit the interlacing of a one-piece core element forming the plurality of air intake passageways to the cylinders and a one-piece core forming the plurality of exhaust gas passageways from the plurality of cylinders. In such methods, a first element of the coolant core is placed in the green sand mold and core elements forming the passageways for the air intakes, and for the cylinder exhausts are then placed in the green sand mold and the second element of the coolant core is joined with the first element of the coolant core, frequently with the use of adhesive. This method entails substantial labor costs and opportunities for unreliable castings. Where adhesive is used, it is necessary that the workman apply the adhesive correctly so that it will reliably maintain the coolant jacket core elements together during casting. It is also necessary that the workman reliably assemble the two elements of the coolant jacket core during manufacture, and assemble the separate core elements in the green sand mold without damaging the interfacing portions of the green sand mold that reliably position the core elements one with respect to the other. This manufacturing method provides an opportunity for the green sand of the mold to be deformed by a workman in assembly of the core elements within the green sand mold, and an opportunity for a lack of reliability in maintaining a reliable location of the plurality of core elements one to the other. The result is that there is no assurance that the thickness of the internal walls of the cylinder head will be reliably maintained during the manufacture, and there is a substantial risk that unreliable castings will result.

This method was improved by the method set forth in U.S. Pat. No. 5,119,881 issued Jun. 9, 1992. This improved method permits a plurality of inter-engaging one-piece core elements to form an integral core assembly, with interlaced passage-forming portions that are reliably positioned and maintained in position to form a cylinder head with reliable wall thickness and an opportunity to decrease the metal content. In this improved method, a core assembly includes for example a two-piece coolant jacket core, a one-piece exhaust core and a one-piece air intake core, all reliably positioned and held together in an integral core assembly that eliminates the more unreliable core element assembly by manufacturing personnel in the green sand mold. In this improved manufacturing method, the integral core assembly was placed in the green sand mold as a whole prior to pouring the molten iron alloy into the green sand mold.

In such casting the core elements that form the internal passageways of the cylinder head are formed with a high-grade "core sand" mixed with a curing resin so that core elements may be formed by compressing the core sand-curing agent mixture, and curing the resin while compressed to form core elements that have sufficient structural integrity to withstand handling and the forces imposed against their outer surfaces by the molten metal that is poured into the mold cavity. The core sand resin is selected to degrade at temperatures on the order of 300 to 400 degrees Fahrenheit so that the core sand may be removed from the interior of the cylinder head after the molten iron alloy has solidified.

Because of the cost of the core sand it is desirable that the sand be recovered for further use after it has been removed from the casting. Recovery of the green sand used in the mold is also desirable; however, the large quantities of the green sand-clay mixture can be degraded sufficiently during the casting process that they cannot be economically recycled and must be hauled away from the foundry and dumped. Since the production of such castings is frequently hundreds of thousands of cylinder heads per year, the cost of handling and disposing of the green sand residue of the casting process imposes a significant unproductive cost in the operation of the foundry. In addition, the core sand frequently becomes mixed with the green sand to such an extent that the core sand cannot be reused in the casting process.

SUMMARY OF THE INVENTION

The invention eliminates the use of green sand by replacing green sand molds with a "core sand" assembly that can provide, during casting, both the internal and external surfaces of the cylinder head or other casting, such as a cylinder block. In the invention, a mold is formed from the same core sand that is used to form the core elements defining the internal passageways of the casting. After the mold and core elements, both of which are formed from core sand, are assembled, they are placed in a carrier with sides that hold the assembled mold and core elements together during pouring of the molten iron alloy into the mold-core assembly and the cooling period during which the molten iron alloy solidifies to form the casting. The invention thus not only eliminates the use of green sand but also obviates the need for the troublesome use of adhesives and fasteners to hold the mold assembly together during casting.

The carrier for the mold-core assembly may take several forms, including, for example, an insulative shell cast from refractory lining materials used, for example, in lining a smelting furnace. The refractory shell may have sufficient thickness to support the core sand mold-core assembly during pouring operations, or may comprise a thinner walled refractory shell carried within a supporting metal framework. Such refractory shell elements may be used for a multiplicity of casting operations before they need to be discarded or repaired. The carrier can also comprise thin, replaceable metal walls supported by a surrounding supportive structure that is sufficiently "open" to expose outside surfaces of the thin, replaceable walls to the ambient atmosphere for cooling.

Preferably, the carrier provides means for pivotally carrying a core sand mold-core assembly from an overhead conveyer. Such means comprise an open-top, bottomless carrier for the core sand mold-core assembly having a pair of downwardly converging side walls for engagement with the core sand mold-core assembly and for retaining the core sand mold-core assembly together during transportation and as molten casting metal is poured into the cavity of the core sand mold-core assembly through the open top of the carrier, and an attachment means, pivotally engaged with the carrier, for carrying the carrier from an over head conveyor without obstruction of its open top.

In the process of the invention, a plurality of mold carriers are provided and a plurality of core sand mold-core assemblies are provided. The mold-core assemblies comprise core sand mold-forming elements and core sand core-forming elements. The core sand mold-core assemblies are loaded, one after another, into the mold carriers and are transported to a pouring station where the core sand mold-core assemblies are filled with molten metal. The poured mold-core assemblies and carriers are then allowed to cool until the castings are formed and are transferred after the cooling period to an unloading station where the carriers are inverted, the castings are retrieved and the core sand is removed from the interior cavities of the castings. The castings are then ready for inspection and further machining operations, and the core sand is recovered and returned to provide a further plurality of core sand elements, either mold elements or core elements or both.

In a preferred process of the invention, a plurality of core sand mold-core assemblies are provided comprising core sand mold elements and core sand core elements. The core sand mold-core assemblies have parting lines and pour openings between two opposed sides thereof. A plurality of carriers having an interiors with open tops and two downwardly converging side walls are provided for the core sand mold-core assemblies, and the plurality of carriers are carried from an overhead carrier, so they may be pivoted about a horizontal axis. The carriers are pivoted about the horizontal axis so their open tops lie substantially vertical, and the mold core assemblies are slid, one at a time, into the carriers through their vertically lying open tops. The carriers are then pivoted so their open tops lie in a horizontal plane and so the weight of the mold-core assemblies is borne by the downwardly converging side walls of the carriers, which hold the mold-core assembly together; and the carriers thus transport the mold-core assemblies to a source of molten casting metal, from which molten casting metal is poured through the open tops of the carriers and into the pour openings of the core sand mold-core assemblies. After the pouring operation, the molten casting metal is allowed to solidify, and the solidified casting, and core sand mold-core assembly are transported to a recovery area where the carriers are pivoted for removal of the solidified castings and the core sand of the mold-core assemblies. The core sand of the core sand mold-core assemblies is recovered, rehabilitated and returned for use to provide further mold elements and core elements.

In the invention, the use of green sand is eliminated by replacing the green sand molds with mold elements formed from green sand for combination with core elements that are formed by core sand and by using reusable mold-core assembly carriers that return the mold-core assemblies together and intact as they are transported and filled with casting metal. By eliminating the use of green sand, the cost of the green sand and its clay binders, the problems associated with mixing of the green sand and core sand and their respective binders, and the environmental costs of disposing of the excess green sand are eliminated.

Other features and advantages of this invention will be apparent from the drawings and more detailed description of the invention that follow.

BRIEF DESCRIPTION OF THE DRAWINGS

FIG. 9 is a block diagram of a preferred process of the invention; and

FIGS. 10A–10E depict schematically some of the steps of the preferred process of FIG. 9.

DETAILED DESCRIPTION OF THE BEST MODE OF THE INVENTION

Figure 1:
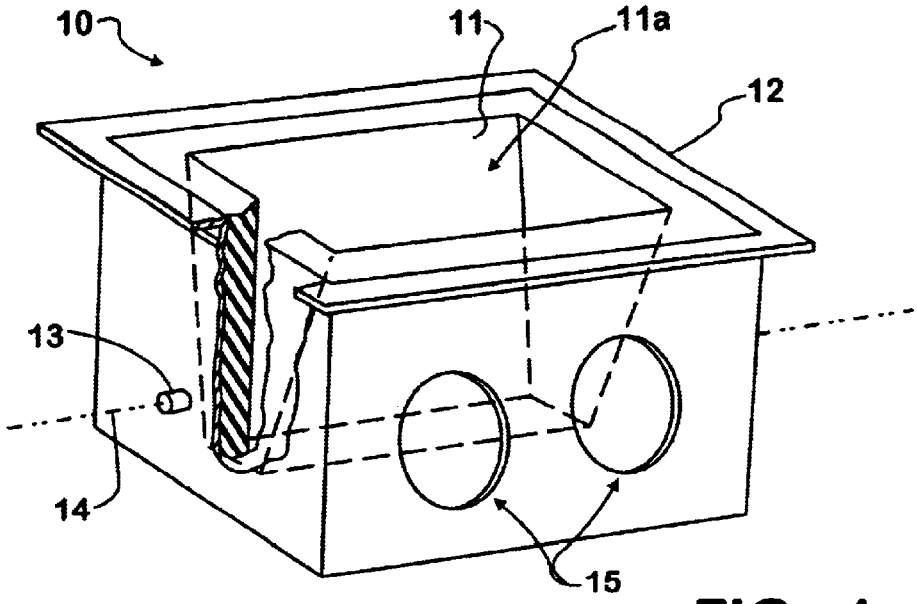
FIG. 1 is a perspective view, partially broken away, of one embodiment of a mold-core assembly carrier used in the invention.
Figure 4:
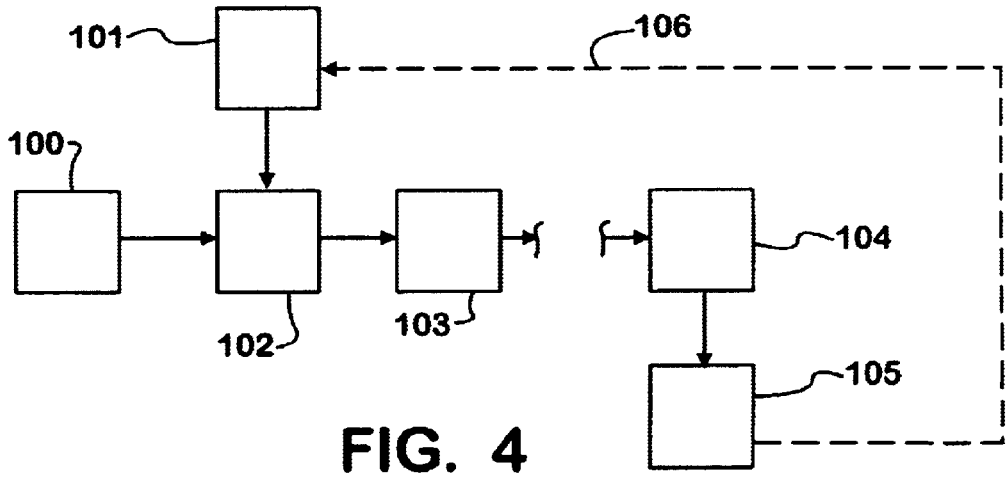
FIG. 4 is a block diagram of a process of the invention.
Figure 5:
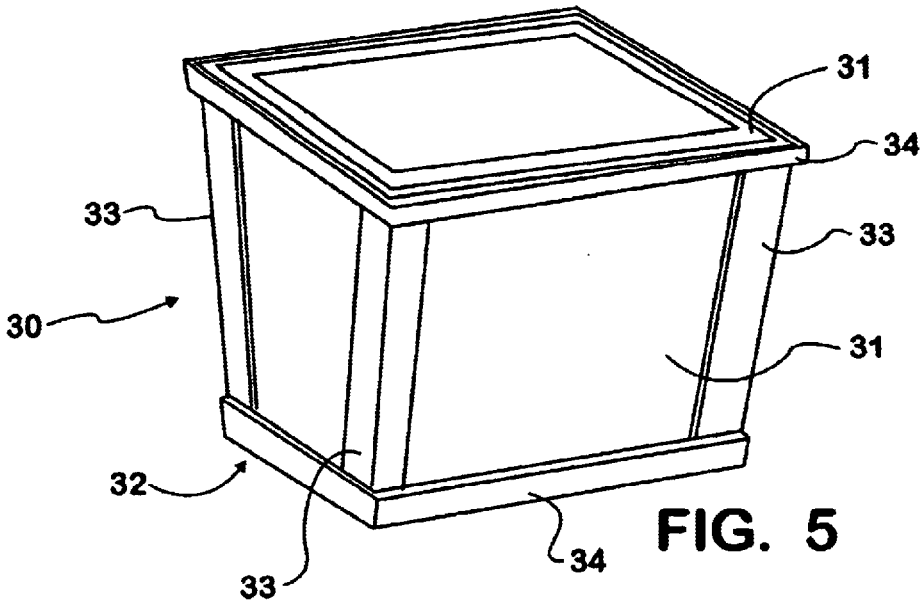
FIG. 5 is a perspective view of another embodiment of a mold-core assembly carrier used in the invention.

FIG. 1 is a perspective view of one embodiment of a mold-core assembly carrier 10 used in the process illustrated in the block diagram of FIG. 4. As illustrated in FIG. 1, the carrier 10 for the mold-core assembly may include a liner 11, formed from a castable refractory material such as the refractory materials used to line the furnaces of iron smelting ovens. Such a refractory liner 11 can be carried in a steel jacket 12. Although FIG. 1 illustrates steel jacket 12 as encompassing the liner 11, except at its open top, with sufficient structural strength in the refractory liner, the steel jacket may be reduced to a supporting steel frame made, for example, from angle and strap iron as shown in FIG. 5. FIG. 1 is partially broken away at one end to illustrate the refractory liner 11.

As further indicated in FIG. 1, steel jacket 12 may be provided with pivot pins 13 located on an axis of rotation 14 below the center of gravity of the carrier 10 so that the carrier 10 will invert unless supported in an upright position. In addition, steel jacket 12 may be optionally provided with one or more openings 15 to permit the refractory liner 11 to be more easily broken out of the steel sleeve 12 if it needs to be replaced.

Figure 2:
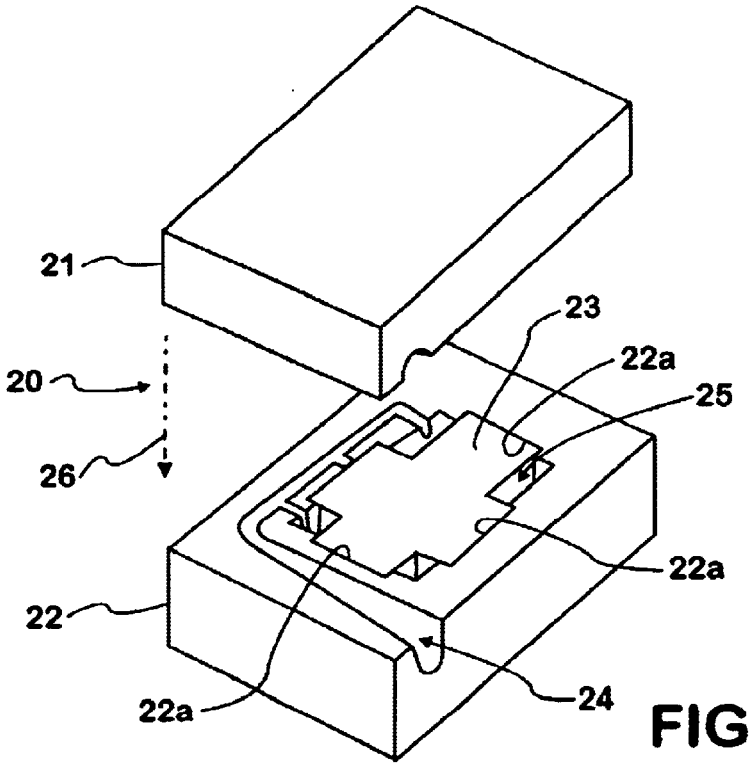
FIG. 2 is a perspective view of a mold-core assembly of the invention, with the mold elements separated to illustrate the internal core assembly.

FIG. 2 illustrates a mold-core assembly 20 including mold elements 21 and 22 that are formed with core sand and resin. As illustrated in FIG. 2, the lower mold element 22 is provided with surfaces 22*a* to position a core assembly 23, which will generally comprise a plurality of assembled core elements, each of which is formed from the core sand used in the mold elements 21 and 22. As further illustrated in FIG. 2, the mold elements 21 and 22 are provided with a passageway 24 into which the molten iron alloy may be poured and carried to fill the mold cavity 25.

In this invention the core assembly 23 may include interior surfaces that cooperate with the mold halves 21, 22 to form outer surfaces of the casting as well as its interior passageways. For example, the underside of the core assembly 23 may be provided with a cavity portion adjacent a portion of its exterior (on the underside of core assembly 23 and not shown in FIG. 2). Although FIG. 2 illustrates the passageway 24 for the molten iron alloy as being formed in both mold elements 21 and 22, the passageway may be formed predominantly in one mold element. In the mold-core assembly 20, the upper mold element 21 is seated and positioned on the lower mold element 22 as indicated by the dashed, arrowed line 26.

Figure 3:
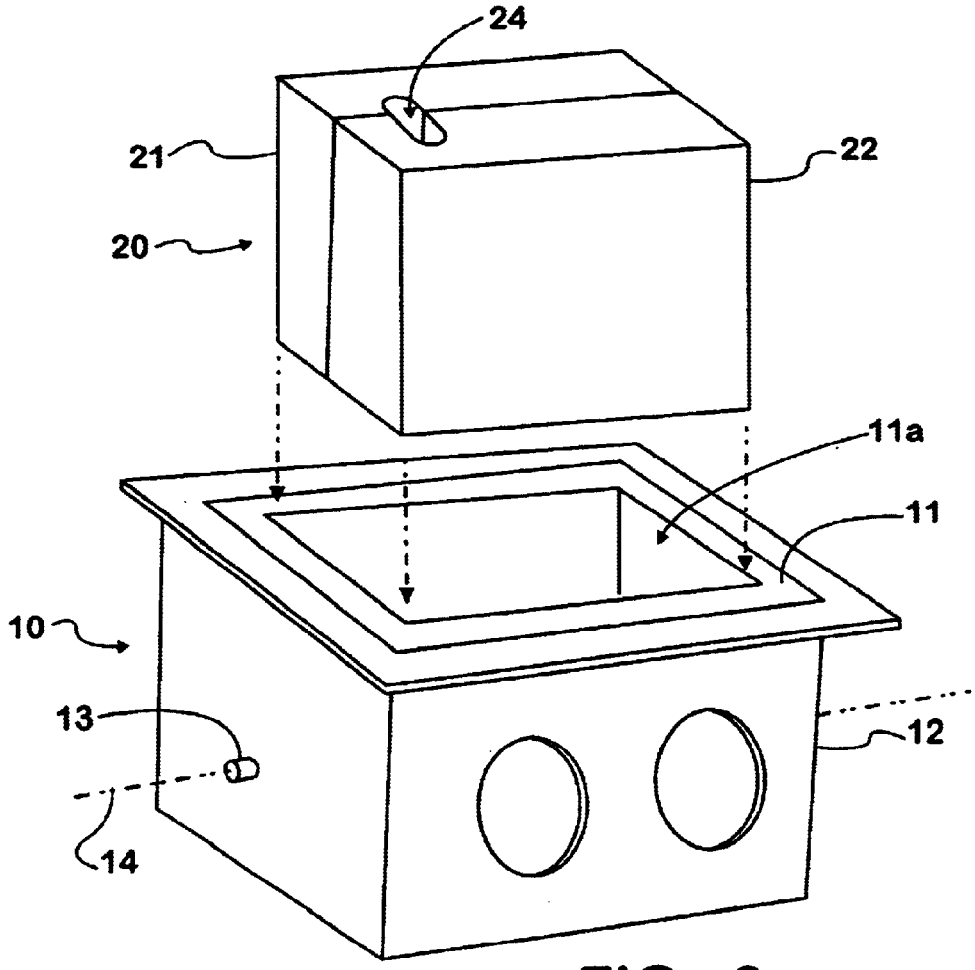
FIG. 3 illustrates the placement of the mold-core assembly of FIG. 2 in the mold-core carrier of FIG. 1.

In a process of the invention, the core assembly 23 is set within the bottom mold element 22 and is positioned therein by positioning surfaces 22*a*, the top mold element 21 is lowered and is positioned on the mold element 22 by inter-engaging mold element surfaces to complete the mold-core assembly 20. The mold-core assembly 20 is then lowered into the central cavity 11*a* of the carrier 10 with the opening 24 for receipt of the molten iron alloy facing upwardly, as shown in FIG. 3. The interior sides of cavity 11*a* may be tapered to allow the weight of the mold-core assembly 20 to retain core elements 21 and 22 in a closed relationship. It will be noted that the taper of the sides of the cavity 11*a* and cavity 40*a* (FIG. 6) is greatly exaggerated for illustrative purposes.

In the process of the invention as illustrated in FIG. 4, a plurality of carriers 10 are provided in first step 100 of the process and a plurality of mold-core assemblies 20, illustrated in FIG. 2, are provided in another first step 101 of the process. The mold-core assemblies 20 are placed in the carriers 10, shown in FIG. 3, at step 102 and are transported to a pouring station 103 where molten iron alloy is poured into the mold-core assemblies 20 through their pour openings 24. The carriers 10 and poured mold-core assemblies 20 are then placed in a holding area for a period, for example, about 45 minutes, to permit the molten iron alloy to solidify and form the casting, the holding period being illustrated in FIG. 4 by the broken line between steps 103 and 104. After the holding period, the carriers 10 are moved to an unloading station 104 where the carriers are permitted to invert, dumping the casting and the remnants of the mold-core assembly for further processing. In the further processing the core sand from both the mold elements 21 22 and core elements 23 of the mold-core assemblies 20 is recovered at step 105 for return and reuse to provide further mold elements or core elements or both, as shown by line 106. As indicated by line 106, the recovered core sand may be rehabilitated, for example, by supplying it with further resin before using the recovered core sand to provide the mold-core assemblies at step 101.

FIG. 5 illustrates an alternative embodiment of carrier 30 that may be used in the invention, in which the mold-core assembly 20 is to be carried by a relatively thin refractory liner 31. The refractory liner 31 is supported by a structural framework 32, for example, a weldment of angle iron 33 and strap iron 34 spaced so that the combination of structural support 32 and liner 31 support the mold-core assembly 20 during pouring. In a further alternative to this embodiment, the liner 31 may be formed by thin metal sheets supported by a structural framework 32.

Figure 6:
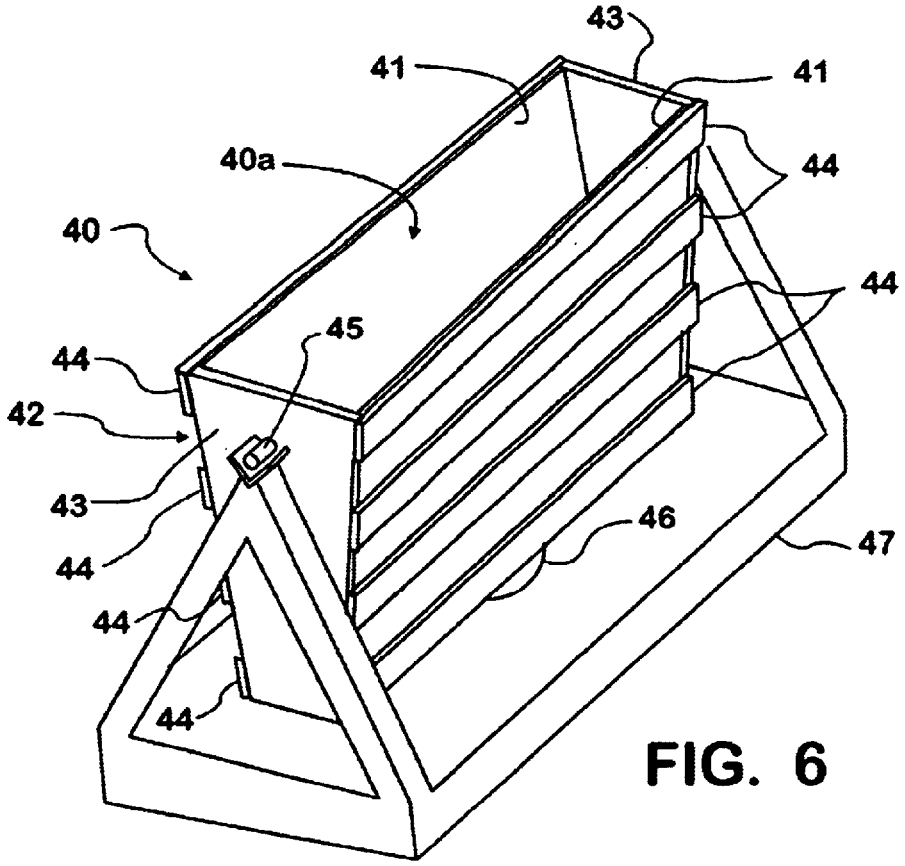
FIG. 6 is a perspective view of a further embodiment of a mold-core assembly carrier used in the invention.

FIG. 6 illustrates, in a perspective view, a further embodiment of a mold-core assembly carrier 40 for provision at step 100 of FIG. 4. The mold-core carrier 40 of FIG. 6 does not employ a refractory material liner. Rather, in the carrier 40, two thin replaceable metal sheets 41 are used to engage the sides of the mold-core assembly 20 and, as a result of their positioning, to hold the mold-core assembly together during pouring and cooling of the casting metal (steps 103 and 104 of FIG. 4). The two thin, replaceable metal sheets 41, which can be, for example, steel sheets ¼ inch thick, are inserted into a structural framework 42 and may be held in place by tack welding. This structural framework 42 can comprise a pair of tapered framework ends 43 held in position by a plurality of side slats 44 which are welded at their ends to the framework ends 43. As indicated by FIG. 6, the slats 44 are widely separated to expose the outside surfaces of the thin metal sheets 41 to ambient atmosphere for cooling the casting.

Alternatively, at least one of the metal sheets 41 may be floatably received in the framework, as by a plurality of studs 48 attached to the sheet 41 and extending through the slats 44 wherein lock nuts 49 are spaced on the studs 48 away from the sheet so that the sheet may slide on the studs 48 to seek its own angle as the mold-core assembly is inserted in the carrier 40 so that the surface of sheet 41 may conform to the adjacent surface of the mold-core assembly 20 to provide a snug fit therewith during pouring.

The framework ends 43 may be provided with pivot pins 45 to permit inversion of the carrier 40 at the unloading station, step 104. To further assist in unloading the mold-core assembly and casting from the carrier 40, the carrier may be provided with a knock-out mechanism, which can include, for example, a cam 46 operated by a cam-operating surface adjacent a conveyor on which the inverted carrier 40 is being moved at station 104. FIG. 6 further illustrates a frame 47 for carrying and storing carrier 40.

A plurality of carriers 40, illustrated in FIG. 6, are provided in first step 100 of the process illustrated in FIG. 4, and a plurality of mold-core assemblies 20, illustrated in FIG. 2, are provided in another first step 101 of the process. The mold-core assemblies 20 are placed into the central cavities 40*a* of the carriers 40 between the thin replaceable metal sheets 41 through their top openings at step 102 and are transported to a pouring station 103 where molten iron alloy is poured into the mold-core assemblies 20 through their pour openings 24. The carriers 40 and poured mold-core assemblies 20 are then placed in a holding area for a period, for example, about 45 minutes, the holding period being illustrated in FIG. 4 by the broken line between steps 103 and 104, to permit the molten iron alloy to solidify and form the castings. After the holding period the carriers 40 are moved to an unloading station 104 where the carriers are inverted and their knock-out mechanisms are operated, for example, by the engagement of cam 46 with a cam-operating surface at unloading station 104, dumping the casting and the remnants of the mold-core assembly for further processing. In the further processing, the core sand from both the mold elements 21, 22 and core elements 23 of the mold-core assemblies 20 is recovered at step 105 for return and reuse to provide further mold elements or core elements or both, as shown by line 106. The recovery step may include both screening to separate the core sand from the other casting residue and magnetic screening of the recovered core sand to remove any metal particulate matter. As indicated by line 106, the recovered core sand may be rehabilitated, for example, by supplying it with further resin before using the recovered core sand to provide the mold-core assemblies at step 101.

Figure 7:
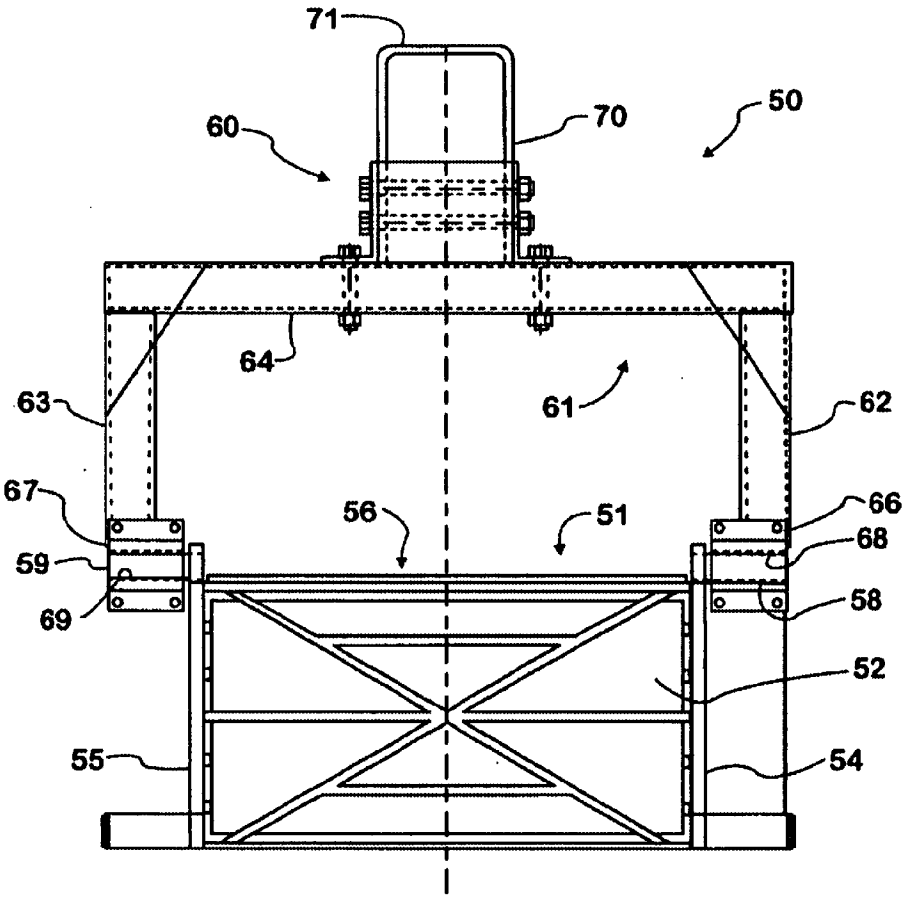
FIG. 7 is a front elevational view of a preferred mold-core assembly carrier of the invention.
Figure 8:
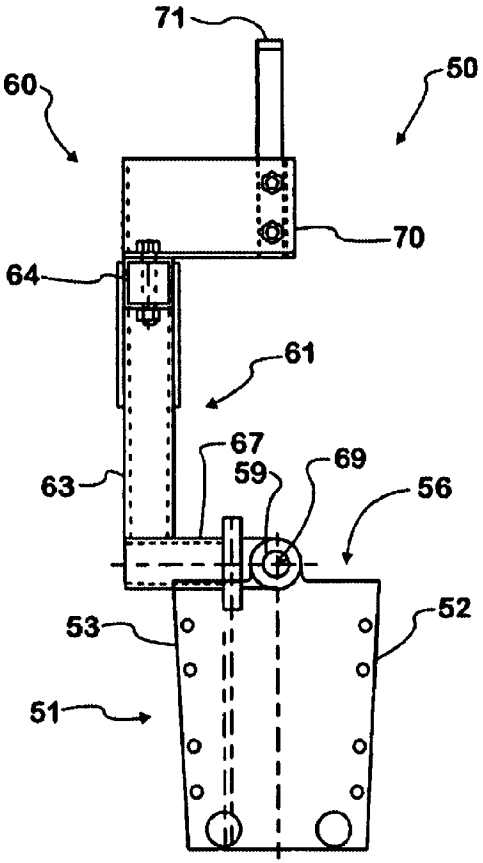
FIG. 8 is a side elevational view of the preferred mold-core assembly carrier of FIG. 7.

FIGS. 7 and 8 are, respectively, a front elevational view and a side elevational view of a preferred carrier apparatus 50 for casting internal combustion engine parts with mold-core assemblies. The carrier apparatus 50 provides means for pivotally carrying a core sand mold-core assembly 28 from an over head conveyor 300 (see FIGS. 10A–10E). As illustrated in FIGS. 7 and 8, the carrier apparatus 50 includes a mold assembly carrier 51 comprising a pair of side walls 52, 53 and a pair of end walls 54, 55 fastened together and providing an interior with an open top 56. As illustrated by FIG. 8, the side walls 52 and 53 converge downwardly, that is, the side walls 52, 53 are spaced more closely at their bottom portions than at the open top 56. Although the carrier 51 has no bottom surface, that is, is open at the bottom, a core sand mold assembly 28 may be contained within the interior formed by the side walls 52, 53 and ends 54, 55 by the downward convergence of side walls 52, 53. As a result of the weight of the core sand mold-core assembly 28, and the engagement of its sides 28*a*, 28*b* with the downwardly converging side walls 52, 53, core sand mold and core elements of the mold assembly are held together. As further illustrated by FIGS. 7 and 8, each of the end walls 54, 55 carries an axle 58, 59 that extends outwardly from the sidewalls 54, 55 and away from the open top 56 of the interior of the carrier 51.

The carrier apparatus 50 further comprises attachment means 60 for attaching the mold-core assembly carrier 51 to an over head conveyor. The attachment means 60, in its preferred form, comprises a U-shaped frame 61 with a pair of arms 62, 63 that depend downwardly from an upper cross member 64 and are spaced outwardly from the side walls 54, 55 of the mold-core assembly carrier 51. Each of the downwardly depending arms 62, 63 has a forwardly projecting portion 66, 67 at its lower end. The distal ends of the forwardly projection portions 66, 67 each have a trunnion surface 68, 69 for carrying one of the axles 58, 59. Attachment means 60 further comprises a bracket 70 for removably attaching the carrier apparatus 50 and mold-core assembly carrier 51 to an over head conveyor. As illustrated by FIGS. 7 and 8, the bracket 70 is attached above and spaced outwardly from the upper leg 64 of the U-shaped bracket 61, locating the central axis of the axles of 58, 59 in substantially the same plane as the upper end 71 of the attachment means 70.

The carrier assembly 50 comprising the mold-core assembly carrier 51 and its attachment means 60 thus comprise a means for pivotally carrying a core sand mold-core assembly 28 from an over head conveyor. In the preferred process of the invention as further described below, the carrier assembly 50 of the invention provides an open top, bottomless carrier 51 for a mold-core assembly 28 having a pair of downwardly converging side walls 52, 53 that engage the sides 28*a*, 28*b* of the core sand mold-core assemblies 28 on each side of the mold-core assembly parting line 29 and hold the mold-core assembly 28 together while it is being transported by the carrier assembly 50 from an over head conveyor. As described above, the mold-core assembly 28, when in position within the mold-core assembly carrier 51 presents its pour opening (e.g., see 24, FIG. 3) adjacent the open top 56 of the mold-core assembly carrier 51, and attachment means 60 does not obstruct the open top 56 of the mold-core assembly carrier 51.

In a preferred process of this invention illustrated in FIG. 9, a plurality of carrier assemblies 50, illustrated in FIGS. 7 and 8, are provided in the first step 200 of the process. As illustrated in FIGS. 7 and 8, the carrier assemblies 50 have interiors with open tops and downwardly converging side walls. In step 201, the plurality of carrier assemblies are attached to and carried by an overhead conveyor (see 300, FIGS. 10B–10E) so their interiors may be pivoted about horizontal axes provided by the axles 58 and 59 of mold-core assembly carriers 51. In step 202, a plurality of mold-core assemblies 28 are provided, the mold-core assemblies comprising mold elements and core elements formed from core sand, which are assembled and provide a parting line 29 and a pour opening between two opposed sides 28*a*, 28*b* thereof. One means of providing such a plurality of mold-core assemblies 28 is by transferring them from an assembly area for loading in the carrier assemblies 50 by means of a rotating carrousel-type of conveyor 301, as depicted in FIG. 10A. In step 203, the mold-core assembly carriers 51 are pivoted about the horizontal axes formed by their axles 58, 59 so that their open tops 56 lie substantially vertically, and the mold-core assemblies 28 are inserted, one at a time, into the mold-core assembly carriers 51 through the vertically lying open tops 56 of the mold-core assembly carriers 51, as depicted in FIG. 10B. At step 204, the mold-core assembly carriers 51 are then pivoted so that their open tops 56 lie in a horizontal plane, and the weight of the mold-core assemblies 28 is carried by the downwardly converging side walls 52, 53 of the mold-core assembly carriers 51, and the mold-core assemblies 28 are retained together by the downwardly converging side walls 52, 53 of the mold-core assembly carriers while they are transported to a source of molten casting metal 302, as depicted in FIG. 10C. Upon reaching the source of molten casting material at step 204, molten casting metal is poured through the open tops 56 of the mold-core assembly carriers 51 and into the pour openings of the mold-core assemblies 28, as depicted in FIG. 10D. The mold-core assemblies 28 with molten casting metal in their internal cavities are then transported by the over head conveyor for a period sufficient for the molten metal to solidify and form the cast articles, as depicted by the broken line between steps 205 and 206. The castings and remnants of the mold-core assembly 28 are transported to a recovery area at which in step 207 the carriers are pivoted, as depicted in FIG. 10E, for removal of the solidified castings and the core sand of the mold-core assemblies. The core sand is recovered and rehabilitated for further use and returned for use in providing further mold elements and core elements for use in the process, as indicated by the dashed line 208.

Thus, the invention provides a method for casting parts for an internal combustion engine without the use of green sand or fasteners. In the method, pluralities of mold elements and core elements, both of which are formed from only core sand and binder, are provided and assembled without fasteners to provide thereby a plurality of mold-core assemblies 28 that form the inner and outer walls of the casting. Each of the mold-core assemblies have a central parting line 29 and a pour opening between two opposing sides 28*a*, 28*b* thereof. In the method, a plurality of mold-core assembly carriers 51 that are adopted to be carried pivotally by an over head conveyor are provided. The mold-core assembly carriers 51 comprise open top, bottomless carriers having a pair of downwardly converging side walls 52, 53 that are engageable with the two sides 28*a*, 28*b* of the mold-core assemblies 28 to maintain the mold-core assemblies 28 together at their parting lines 29 while they are being carried and filled with molten casting metal. The mold-core assembly carriers 51 further include means 60 for attaching them pivotally to an overhead conveyor so the mold-core assemblies may be pivoted with respect to their attachment means. The attachment means 60 do not obstruct access to the open top 56 of the mold-core assembly carriers 51 or to the pour openings of the mold-core assemblies 28. The plurality of mold-core assemblies 28 and the plurality of mold-core assembly carriers 51 are transported to a loading station where the mold-core assembly carriers 51 are pivoted so their open tops 51 lie vertically and so the mold-core assemblies 28 can be inserted into the mold-core assembly carriers 51 through their open tops 56 with the two sides 28*a*, 28*b* of the mold-core assemblies engaged with the converging sides 52, 53 of the mold-core assembly carriers 51 and with the pour openings of the mold-core assemblies located within the open tops 56 of the mold-core assembly carriers 51. The mold-core assembly carriers 51 are then allowed to pivot so the mold-core assemblies 28 that they carry have their parting lines 29 substantially vertically oriented and their pour openings accessible from above through the open tops 56 of the mold-core assembly carriers 51, and the mold-core assemblies 28 are transported by the mold-core assembly carriers 51 from the loading station to a pouring station. At the pouring station, molten casting metal is poured through the open tops 56 of the mold-core assembly carriers 51 and into the pour openings of the mold-core assemblies 28 which are retained in their assembled form by the downwardly converging sides 52, 53 of the mold-core assembly carriers 51. The molten metal is then allowed to solidify into castings and the resulting castings, and the mold-core assemblies 28 are transported to an unloading station where the mold-core assembly carriers 51 are then pivoted through an angle of, for example, about 90° to 120° so the castings and the remnants of the mold-core assemblies 28 can be removed through the open tops 56 of the mold-core assembly carriers 51, if necessary with the assistance of an unloading means operating through the open bottoms of the mold-core assemblies to push the castings and core sand from the mold-core assembly carriers 28 from the interiors of the mold-core assembly carriers. The core sand comprising the remnants of the mold-core assemblies is then recovered and processed, as set forth above, to provide a further plurality of mold elements and core elements for use in the method as described in greater detail above.

Other embodiments and applications of the invention will be apparent to those skilled in the art from the drawings and methods of the invention described above without departing from the scope of the claims that follow. For example, although taught in connection with a cylinder head casting, the invention may be applied to other castings, such as engine blocks, transmission housings, and large valves housings, with little modification.

What is claimed is:

1. A method for casting parts for an internal combustion engine with a mold-core assembly formed from core sand mold elements and core sand core elements, said method comprising providing a plurality of mold elements formed from core sand and a plurality of core elements formed from core sand;

assembling the plurality of core sand mold elements and core sand core element and providing thereby a plurality of mold-core assemblies for the formation of the outer and inner walls of a casting, each of said mold-core assemblies having a central parting line and a pour opening between two opposed sides thereof;

providing a plurality of carrier assemblies adapted to pivotally carry said mold-core assemblies from an over head conveyor, each of said carrier assemblies comprising an open topped bottomless mold-core assembly carrier having a pair of downwardly converging side walls engageable with said two sides of one of said mold-core assemblies and maintaining the mold-core assembly together at its parting line while the mold-core assembly is being carried and filled with molten casting metal, said carrier assemblies further comprising attachment means for pivotally carrying the mold-core assembly carriers, said mold-core assembly carrier and said attachment means being connected by pivotal means permitting the mold-core assembly to be pivoted with respect to the attachment means, said attachment means being adapted and located so the open top of the mold-core assembly is unobstructed;

transporting said plurality of mold-core assemblies and said plurality of mold-core assembly carriers to a loading station;

pivoting said mold-core assembly carriers at the loading station so their open tops lie vertically, and inserting said mold-core assemblies into the mold-core assembly carriers through their open tops with said two sides thereof engaged with said converging sides of the mold-core assembly carriers and with the pour openings of said mold-core assemblies located within the open tops of the mold-core assembly carriers;

pivoting the mold-core assembly carriers so the mold-core assemblies are carried with their parting lines substantially vertically orientated and their pour openings accessible through the open tops of the mold-core assembly carriers, and transporting the mold-core assemblies from the loading station to a pouring station;

pouring molten casting metal through the open tops of the mold-core assembly carriers and into the pour openings of the mold-core assemblies, while retaining the mold-core assemblies together with the downwardly converging sides of the mold-core assembly carriers;

allowing the molten metal to solidify into castings;

unloading the castings and mold-core assemblies in an unloading station; and recovering and processing the core sand of the mold-core assemblies to provide a further plurality of mold elements and/or core elements.

2. The method of claim 1 wherein the step of recovering and processing the core sand to provide a further plurality of mold elements and/or core elements includes the steps of rehabilitating recovered core sand by the addition of further binder and mixing the recovered core sand and new core sand as needed to form the further plurality of the mold elements and/or core elements.

3. The method of claim 1 wherein the casting and mold-core assembly are unloaded by pivoting the mold-core assembly carrier and dumping its contents.

4. The method of claim 3 wherein the mold-core assembly carrier is pivoted through an angle of 90 °–120°.

5. The method of claim 3 wherein the mold-core assembly carrier is pivoted through an angle of less than 180°.

6. A method of casting internal combustion engine parts, comprising providing a plurality of mold-core assemblies comprising core sand mold elements and core sand core elements, each of sand mold-core assemblies having a parting line and pour opening between two opposed sides thereof;

providing a plurality of carriers for said mold-core assemblies, said carriers having interiors with an open tops and downwardly converging said walls;

carrying said plurality of carriers from an over head carrier so they may be pivoted about a horizontal axis;

pivoting said carriers about a horizontal axis so their open tops are substantially vertical;

sliding mold-core assemblies, one at a time, onto the carriers through the vertically lying open tops of the carriers;

pivoting the carriers so their open tops are in a horizontal plane and the mold-core assemblies are engaged with, and retained intact, by the downwardly converging side walls of the carriers;

transporting the mold-core assemblies to a source of molten casting metal;

pouring molten casting metal through the open tops of the carriers and into the pour openings of the mold-core assemblies;

allowing the molten casting metal to solidify;

transporting the solidified castings and mold-core assemblies to a recovery area and pivoting the carriers for removal of the castings and the core sand of the mold-core assemblies;

recovering the core sand; and rehabilitating the recovered core sand and returning it for use to provide mold elements and core elements.

7. A casting method for castings having internal passages, comprising:

providing a plurality of carriers, said carriers including an open top and an interior formed by a pair of sides that converge downwardly and a pair of side-supporting ends;

providing a plurality of mold elements formed from core sand with a mold cavity for the formation of the outer walls of the castings;

providing a plurality of core elements formed from core sand for forming the internal passageways of the castings;

assembling the mold elements and core elements into a plurality of mold-core assemblies wherein each mold-core assembly has a top opening that permits molten metal to be poured downwardly through the open tops of the carriers;

loading the mold-core assemblies, one at a time, into the open tops of the carriers;

transporting the mold-core assemblies and carriers to a pouring station, said carriers through their downwardly converging sides holding the mold assembly together within the carriers, and pouring molten metal into the mold-core assemblies;

allowing the molten metal solidify into castings;

unloading the castings and mold-core assemblies in an unloading station;

recovering the core sand of the mold elements and core elements; and rehabilitating the recovered core sand and returning it for use to provide mold elements and core elements.

8. The method of claim 7 wherein the step of rehabilitating the recovered core sand includes the addition of further binder and the mixing of the recovered core sand and new core sand as needed to form mold elements and core elements of the mold-core assembly.

9. The method of claim 7 wherein the casting and mold-core assemblies are unloaded by inverting the carriers and dumping their contents.

10. The method of claim 9 wherein the carriers includes pivot pins and the carriers are inverted about their pivot pins.

11. The method of claim 7 wherein the core sand is recovered by a screening process.

12. The method of claim 7 wherein the recovered core sand is rehabilitated by magnetic screening to remove particulate metal.

13. The method of claim 9 wherein the carriers include knock-out mechanisms operated after their inversion to assist dumping the contents of the carriers.

14. The method of claim 13 wherein the knock-out mechanisms include a cam operated surface that is engaged and operated as the carriers are moved by a conveyor.

15. A casting apparatus for a casting having internal passages, comprising a mold core assembly including mold elements formed from core sand, joined at a vertical parting line, and defining a mold cavity for the formation of an outer wall of a casting;

a core element disposed within said mold cavity formed from core sand and defining an internal passageway of the casting; and a mold-core, assembly carrier having sides that converge downwardly and end plates, and defining an internal cavity having an open top, said mold-care assembly being disposed thereinside and retained together in defining the mold cavity by its engagement with the downwardly converging sides of the mold-core assembly carrier and having a top opening that permits molten metal to be poured downwardly through the open top of the carrier.

16. The casting apparatus of claim 15 wherein the mold-core carrier sides comprise open frame structures and thin steel side sheets disposed between the open frame structures and the mold-core assemblies.

17. The casting apparatus of claim 16 wherein the thin steel side sheets are attached to the frame structure.

18. The casting apparatus of claim 16 wherein the thin steel side sheets are replaceably attached to the frame structure.

19. The casting apparatus at claim 15 wherein a steel side sheet is floatingly attached to the frame structure to permit the angle of the side sheet to conform to the angle of the adjacent surface of the mold-core assembly.

* * * * *